US011608966B1

(12) United States Patent
Groat

(10) Patent No.: US 11,608,966 B1
(45) Date of Patent: Mar. 21, 2023

(54) ADJUSTABLE RISER AND ASSEMBLIES

(71) Applicant: CLAROLUX, Inc., Greensboro, NC (US)

(72) Inventor: Brian Groat, Greensboro, NC (US)

(73) Assignee: CLAROLUX, Inc., Greensboro, NC (US)

( * ) Notice: Subject to any disclaimer, the term of this patent is extended or adjusted under 35 U.S.C. 154(b) by 0 days.

(21) Appl. No.: 17/468,740

(22) Filed: Sep. 8, 2021

Related U.S. Application Data

(60) Provisional application No. 63/075,428, filed on Sep. 8, 2020, provisional application No. 63/078,953, filed on Sep. 16, 2020.

(51) Int. Cl.
*F21V 19/02* (2006.01)
*F21V 23/06* (2006.01)

(52) U.S. Cl.
CPC ..... *F21V 19/02* (2013.01); *F21V 23/06* (2013.01)

(58) Field of Classification Search
CPC ..... F21V 19/02; F21V 23/06; F21V 21/08; F21V 21/14; F21V 21/145
See application file for complete search history.

(56) References Cited

U.S. PATENT DOCUMENTS

| | | | | | |
|---|---|---|---|---|---|
| 1,608,701 | A * | 11/1926 | Lang | B60Q 3/12 | 362/359 |
| 6,866,409 | B2 * | 3/2005 | Fields | F21S 41/198 | 362/519 |
| D583,989 | S * | 12/2008 | Khubani | D26/138 | |
| 10,088,134 | B1 * | 10/2018 | Helms | F21V 21/14 | |
| 2007/0291477 | A1 * | 12/2007 | Khubani | F21V 21/02 | 362/191 |
| 2016/0258605 | A1 * | 9/2016 | Fischer | H02G 3/20 | |

* cited by examiner

*Primary Examiner* — Peggy A Neils
(74) *Attorney, Agent, or Firm* — MacCord Mason PLLC

(57) ABSTRACT

Light fixture adjustable riser systems, assemblies, and devices are shown and described. In one embodiment, the adjustable riser assembly includes a lower plate having an alignment surface and an offset lip; a fastener removably may be secured between the alignment surface and the offset lip; and an adjustable upper plate may be adjustably secured about the fastener.

17 Claims, 8 Drawing Sheets

ADJUSTABLE RISER AND ASSEMBLIES

This application claims the benefit of U.S. provisional application No. 63/078,953, filed Sep. 16, 2020; and U.S. provisional application No. 63/075,428, filed Sep. 8, 2020, both of which are incorporated herein by reference in their entireties.

FIELD OF THE TECHNOLOGY

The present disclosure relates generally to fixture supports, and more particularly to improved adjustable riser and electrical terminal block fixture connection devices and assemblies.

SUMMARY

In accordance with the present disclosure, adjustable risers and universal light fixture mounting systems and assemblies are provided for a wide variety of applications to secure a powered fixture about a surface, and the like. This disclosure provides improved assemblies and devices that are convenient, efficient, and safe for the user, particularly when used to provide sensitive adjustability of the position a lamp socket about a surface, support plate(s), and the like.

In one embodiment, in an assembly to support a lamp socket, an adjustable riser comprises a lower plate having an alignment surface and an offset lip; a fastener may be removably secured between the alignment surface and the offset lip; and an adjustable upper plate may be adjustably secured about the fastener.

In one embodiment, in an assembly to support a lamp socket, an adjustable riser comprises a lower plate having an alignment surface and an offset lip; and an adjustable upper plate may be adjustably aligned between the alignment surface and the offset lip.

In one embodiment, an adjustable riser assembly includes a lower plate having an alignment surface and an offset lip, extension, or the like; a fastener removably secured between the alignment surface and the offset lip; and an adjustable upper plate secured about the fastener and adjustably positioned between the alignment surface and the offset lip.

In particular examples, a lamp socket is secured about the adjustable upper plate. The lower plate may include a neck spacing the alignment surface and the offset lip. The alignment surface may be separated substantially parallel about the offset lip. The assembly may include an elbow between the neck and the alignment surface. The assembly may include an elbow between the neck and the offset lip.

In certain examples, the lower plate includes at least one distal fastener aperture. The at least one distal fastener aperture may include internal threading to adjustably receive the fastener. The offset lip may include at least one proximate fastener aperture. The at least one proximate fastener aperture may include internal threading adapted to adjustably receive the fastener. Further, the lower plate may include at least one distal fastener aperture and the offset lip includes at least one proximate fastener aperture, and wherein the distal fastener aperture radially aligned about the proximate fastener aperture.

In particular examples, the lower plate includes an alignment slot. The alignment slot may include a central aperture. The lower plate may include a mounting hole adapted to secure a fastener about a surface. The assembly may include a pair of mounting holes offset about an alignment slot.

In certain examples, the adjustable upper plate includes a securement block. The securement block may include a positioning aperture adapted to adjustably receive the fastener. The positioning aperture may include internal female threads adapted to receive opposing male threads of the fastener. The upper plate may include a mounting engagement surface adapted to secure a low voltage light socket adjustably spaced about the lower plate.

In one embodiment, an adjustable riser assembly comprises a lower plate having a proximate surface engagement portion and a spaced apart distal lip; and an upper plate adapted to support a lamp socket and adjustably secured between the proximate surface engagement portion and the spaced apart distal lip.

In particular examples, a neck may space the proximate surface engagement portion and the spaced apart distal lip. The lower plate may have an alignment surface. The spaced apart distal lip may include an offset lip. The offset lip may include at least one proximate fastener aperture. The at least one proximate fastener aperture may include internal threading adapted to adjustably receive the fastener.

In certain examples, the upper plate may adjustably secure about a fastener. The lower plate may include at least one distal fastener aperture. The at least one distal fastener aperture may include internal threading adapted to adjustably receive the fastener. The lower plate may include at least one distal fastener aperture and the distal lip may include at least one proximate fastener aperture, and wherein the distal fastener aperture radially may align about the proximate fastener aperture.

In particular examples, the lower plate includes an alignment slot. The alignment slot may include a central aperture. The lower plate may include a mounting hole adapted to secure a fastener about a surface. The assembly may include a pair of mounting holes offset about an alignment slot.

In certain examples, the adjustable upper plate includes a securement block. The securement block may include a positioning aperture adapted to adjustably receive the fastener. The positioning aperture may include internal female threads adapted to receive opposing male threads of the fastener. The upper plate may include a mounting engagement surface adapted to secure a low voltage light socket adjustably spaced about the lower plate.

In one embodiment, a light fixture system comprises a lower plate having an alignment surface and an offset lip; a fastener removably secured between the alignment surface and the offset lip; an adjustable upper plate secured about the fastener and adjustably vertically positioned between the alignment surface and the offset lip; and a lamp socket secured about the adjustable upper plate.

In particular examples, the lamp socket includes a universal body having an upper engagement surface; a pair of opposing terminal block inlet cavities adapted to receive a power input, and having a distal block in communication with a connection port aligned about the engagement surface; and a pair of offset quick-connect mount chambers having a connection aperture aligned about the engagement surface and adapted to receive a bi-pin light fixture.

In certain examples, a landscape cable directly delivers power about the terminal block inlet cavities. The landscape cable may directly deliver power about the socket free of a connector. The landscape cable may directly deliver power about the socket free of a heat shrink. The universal body may directly deliver a partially exposed bottom. The pair of opposing terminal block inlet cavities and the pair of offset quick-connect mount chambers may be aligned deliver about the partially exposed bottom. The universal body may directly deliver at least one mounting ground connection.

The upper engagement surface may directly deliver to removably engage a light fixture.

In certain examples, the system may include a first quick-connect mount chamber separates the pair of opposing terminal block inlet cavities. The system may include a second quick-connect mount chamber aligned on a reverse face of the pair of opposing terminal block inlet cavities. The connection aperture may secure a quick connect member. The connection aperture may secure a push-to-connect member. The opposing terminal block inlet cavities may include a distal block in communication with the proximate block. The landscape cable may directly deliver power about the terminal block inlet cavities.

In one embodiment, a lamp socket includes a universal body having an upper engagement surface; a pair of opposing terminal block inlet cavities having a distal block in communication with a connection port aligned about the engagement surface; and a pair of offset connect mount chambers having a connection aperture aligned about the engagement surface.

In particular examples, the universal body comprises at least one mounting rail. The universal body may include a substantially hollow body. The terminal block inlet cavities may receive a power input. A fastening member may protrude from the connection port, for instance fixedly securing a power input about the terminal block. The terminal block inlet cavities may include a proximate block. The distal block may be substantially offset about the proximate block.

In certain examples, a fastening member protrudes from the connection port comprises a protruding fastener. The protruding fastener may include a screw type connection. The connection port may include internal receiving threads.

In particular examples, the power input may include a low voltage landscaping lighting cable. The landscape cable may directly deliver power about the terminal block inlet cavities. The landscape cable may directly deliver power about the socket free of a connector. The landscape cable may directly deliver power about the socket free of a heat shrink.

In certain examples, the device may include a partially exposed bottom. The pair of opposing terminal block inlet cavities and the pair of offset connect mount chambers may be aligned about the partially exposed bottom. The device may include a convex support aligned between a first terminal block inlet and a first connect mount chamber.

In particular examples, the first connect mount chamber separates the pair of opposing terminal block inlet cavities. The second connect mount chamber may be aligned on a reverse face of the pair of opposing terminal block inlet cavities. The connect mount chambers may have a connection aperture adapted to receive a lamp. The device may include a light fixture. The light fixture may include a bi-pin light fixture. The connection aperture may include secure a quick connect member. The connection aperture may secure a push-to-connect member. The connection aperture may be aligned radially about the mount chamber. The connection aperture may include socket springs, for instance mini socket springs.

In certain examples, the connection aperture comprises support plates. The connection aperture may include fasteners, for instance adjustable fasteners. The device may include a light fixture. The device a light fixture a support system.

In one embodiment, a lamp socket includes a universal body having an upper engagement surface; a pair of opposing terminal block inlet cavities adapted to receive a power input, and having a distal block in communication with a connection port aligned about the engagement surface; and a pair of offset quick-connect mount chambers having a connection aperture aligned about the engagement surface and adapted to receive a bi-pin lamp.

In particular examples, a landscape cable directly delivers power about the terminal block inlet cavities. The landscape cable may directly deliver power about the socket free of a connector. The landscape cable may directly deliver power about the socket free of a heat shrink.

In certain examples, the universal body comprises a partially exposed bottom. The pair of opposing terminal block inlet cavities and the pair of offset quick-connect mount chambers may be aligned about the partially exposed bottom. The universal body may comprise at least one mounting ground connection. The upper engagement surface may removably engage a light fixture. The device may include a first quick-connect mount chamber separates the pair of opposing terminal block inlet cavities. The device may include a second quick-connect mount chamber aligned on a reverse face of the pair of opposing terminal block inlet cavities.

In particular examples, the connection aperture secures a quick connect member. The connection aperture may secure a push-to-connect member. The opposing terminal block inlet cavities may include a distal block in communication with the proximate block. The landscape cable may directly deliver power about the terminal block inlet cavities.

In one embodiment, a universal connection assembly includes a power input; a pair of opposing terminal block inlet cavities receiving the power input and having a fastening member protruding from a connection port fixedly securing the power input about the terminal block; and a pair of offset quick-connect mount chambers having a connection aperture.

In particular examples, the opposing terminal block inlet cavities comprise a proximate block. The opposing terminal block inlet cavities may include a distal block in communication with the proximate block. The distal block may be aligned substantially offset about the proximate block. The fastening member protruding from the connection port may include a protruding fastener. The protruding fastener may include a screw type connection. The connection port may include internal receiving threads.

In certain examples, the power input comprises a low voltage landscaping lighting cable. The landscape cable may directly deliver power about the terminal block inlet cavities. The landscape cable may directly deliver power about the socket free of a connector. The landscape cable may directly deliver power about the socket free of a heat shrink.

In particular examples, the assembly comprises a partially exposed bottom. The pair of opposing terminal block inlet cavities and the pair of offset quick-connect mount chambers may be aligned about the partially exposed bottom. The assembly may include a convex support aligned between a first terminal block inlet and a first quick-connect mount chamber. The assembly may include a first quick-connect mount chamber separates the pair of opposing terminal block inlet cavities. The assembly may include a second quick-connect mount chamber aligned on a reverse face of the pair of opposing terminal block inlet cavities.

In one embodiment, a universal connection assembly includes a bi-pin light fixture; a pair of offset quick-connect mount chambers having a connection aperture receiving the bi-pin light fixture; and a pair of opposing terminal block inlet cavities having a distal block in communication with a connection port.

In particular examples, the connection aperture secures a quick connect member. The connection aperture may secure a push-to-connect member. The connection aperture may be aligned radially about the mount chamber. The connection aperture may include socket springs. The socket springs may include mini socket springs. The connection aperture may include support plates. The connection aperture may include fasteners. The fasteners may include adjustable fasteners. The assembly may include a first quick-connect mount chamber separates the pair of opposing terminal block inlet cavities. The assembly may include a second quick-connect mount chamber aligned on a reverse face of the pair of opposing terminal block inlet cavities. The assembly may include a partially exposed bottom. The pair of opposing terminal block inlet cavities and the pair of offset quick-connect mount chambers may be aligned about the partially exposed bottom. The assembly may include a convex support aligned between a first terminal block inlet and a first quick-connect mount chamber.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
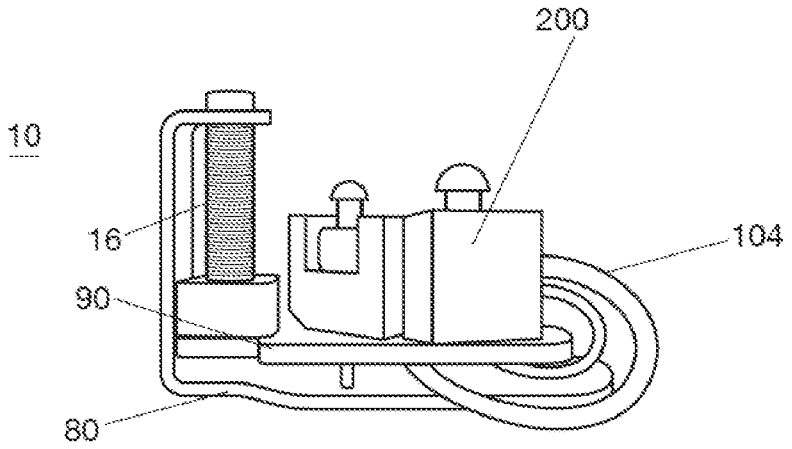
FIG. 1 is a side perspective view of one embodiment of an assembly according to the present disclosure.
Figure 1A:
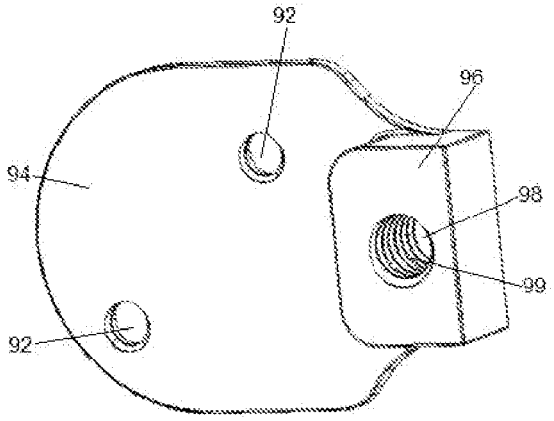
FIG. 1*a* is an isolated top perspective view of one embodiment of an element introduced in FIG. 1, with elements removed for clarity.
Figure 1B:
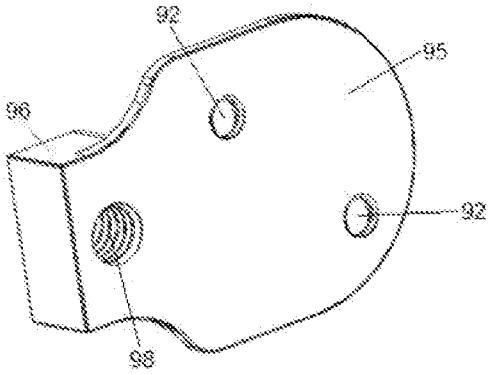
FIG. 1*b* is an isolated bottom perspective view of one embodiment of an element introduced in FIG. 1, with elements removed for clarity.
Figure 1C:
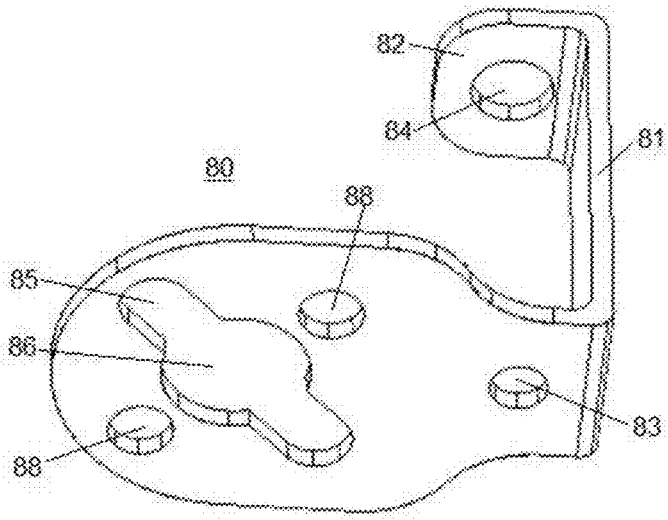
FIG. 1*c* is an isolated bottom perspective view of one embodiment of an element introduced in FIG. 1, with elements removed for clarity.
Figure 1D:
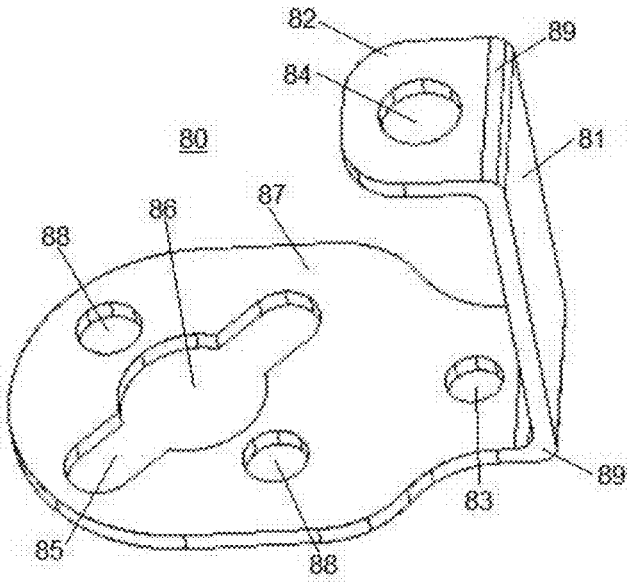
FIG. 1*d* is an isolated top perspective view of one embodiment of an element introduced in FIG. 1, with elements removed for clarity.
Figure 1E:
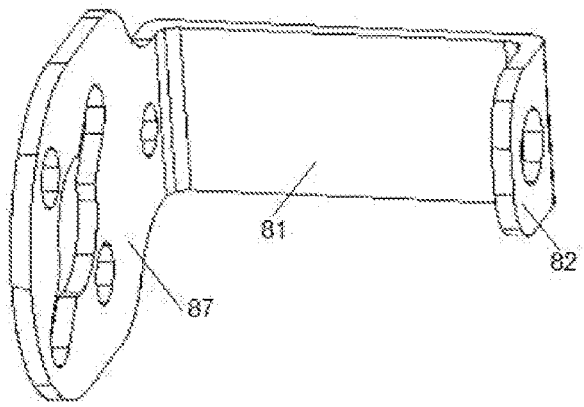
FIG. 1*e* is an isolated side perspective view of one embodiment of an element introduced in FIG. 1, with elements removed for clarity.
Figure 1F:
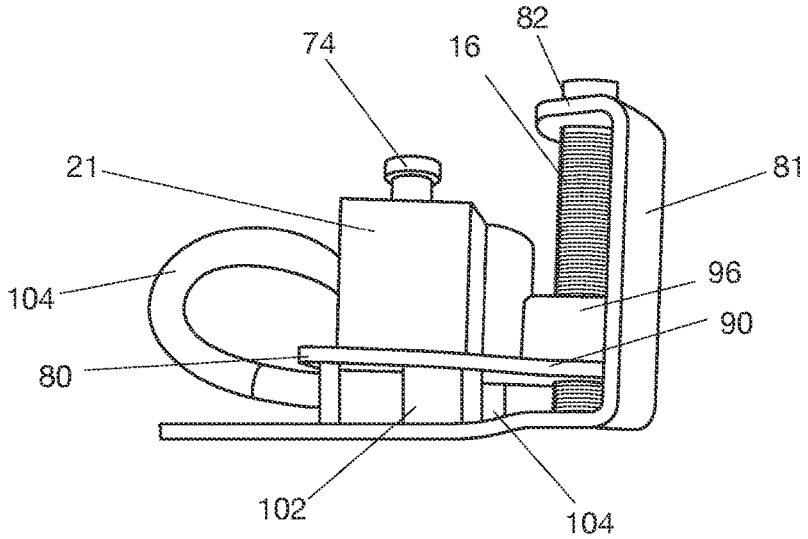
FIG. 1*f* is a side perspective view of the embodiment introduced in FIG. 1.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 1G:
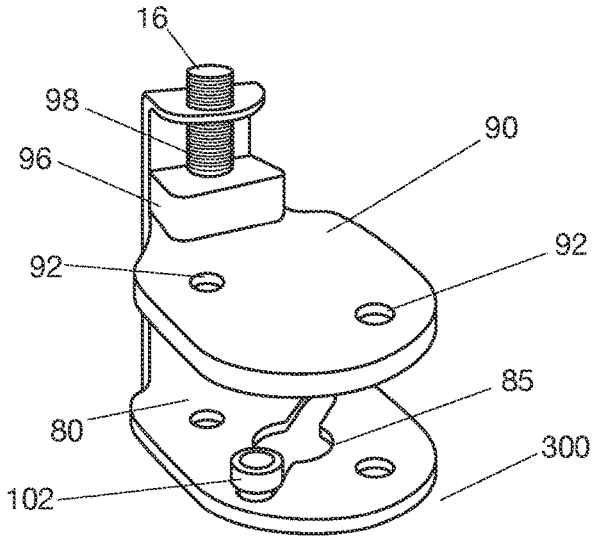
FIG. 1*g* is a top perspective view of the embodiment introduced in FIG. 1, with elements removed for clarity.
Figure 2:
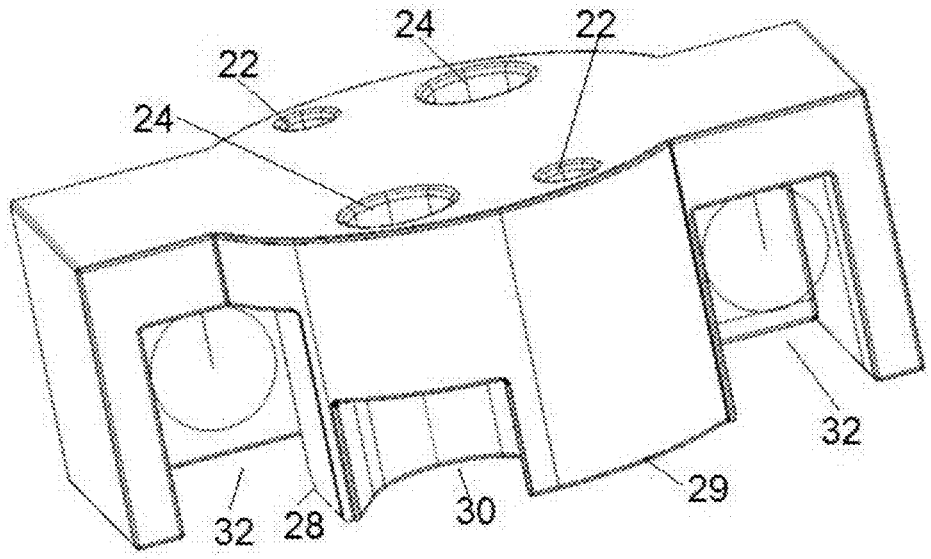
FIG. 2 is a top perspective view of one embodiment of a device according to the present disclosure, with elements removed for clarity.
Figure 2A:
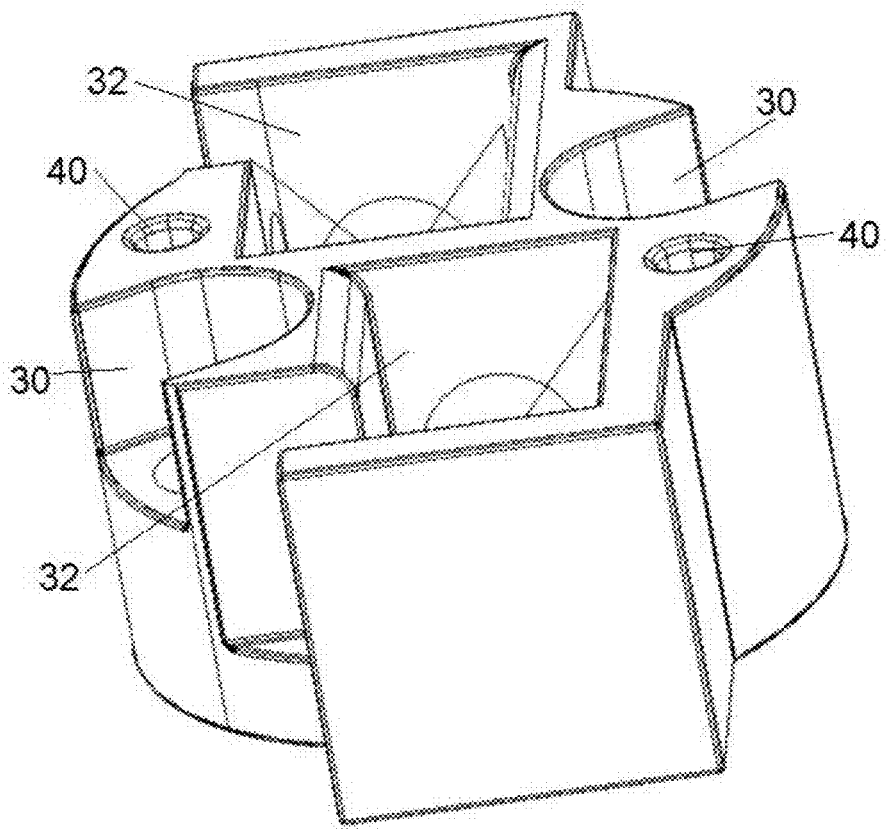
FIG. 2*a* is a side perspective view of the embodiment introduced in FIG. 2.
Figure 3:
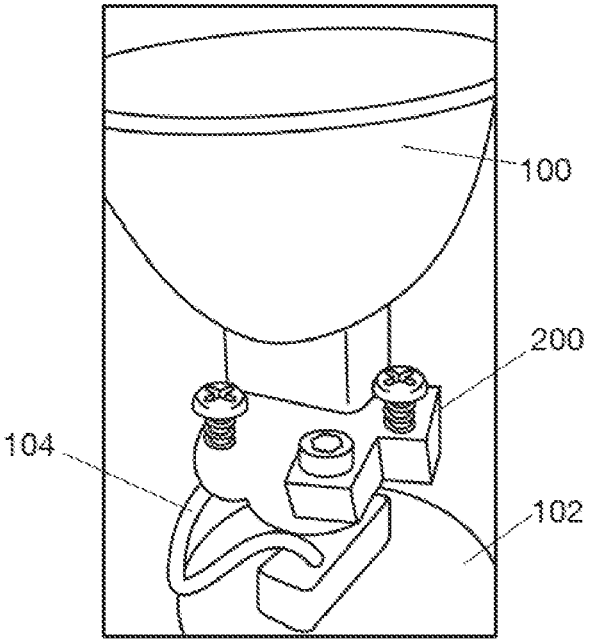
FIG. 3 is a side perspective view of an assembly with the embodiment introduced in FIG. 2.
Figure 4:
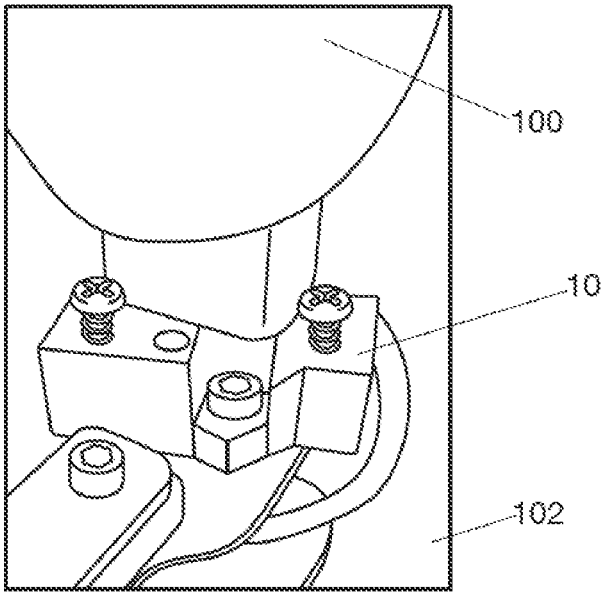
FIG. 4 is a side perspective view of an assembly with the embodiment introduced in FIG. 2.
Figure 5:
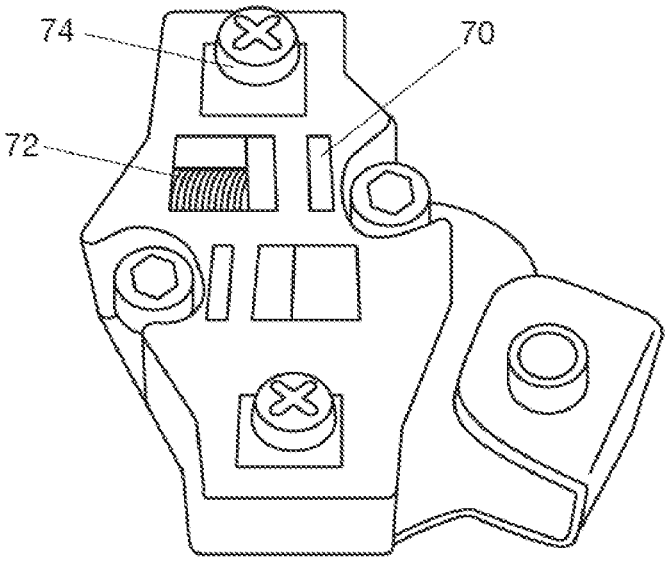
FIG. 5 is a top perspective view of an assembly with the embodiment introduced in FIG. 2, with elements removed for clarity.
Figure 6:
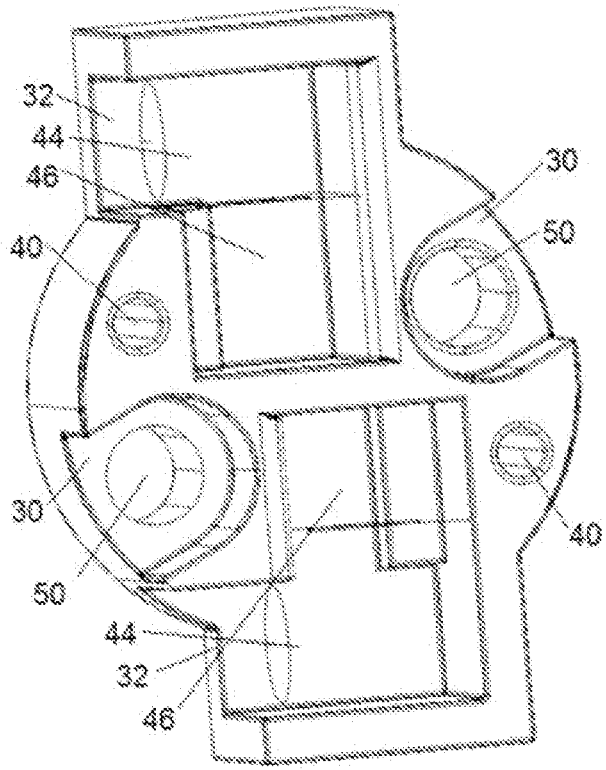
FIG. 6 is a side perspective view of the embodiment introduced in FIG. 2.
Figure 7:
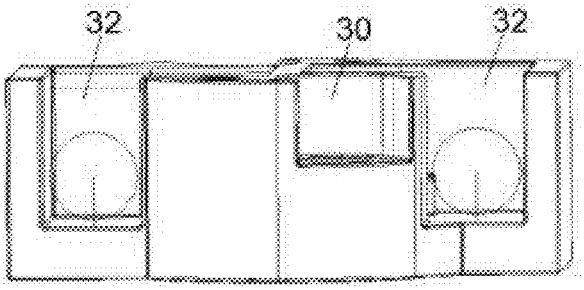
FIG. 7 is a side view of the embodiment introduced in FIG. 2.
Figure 8:
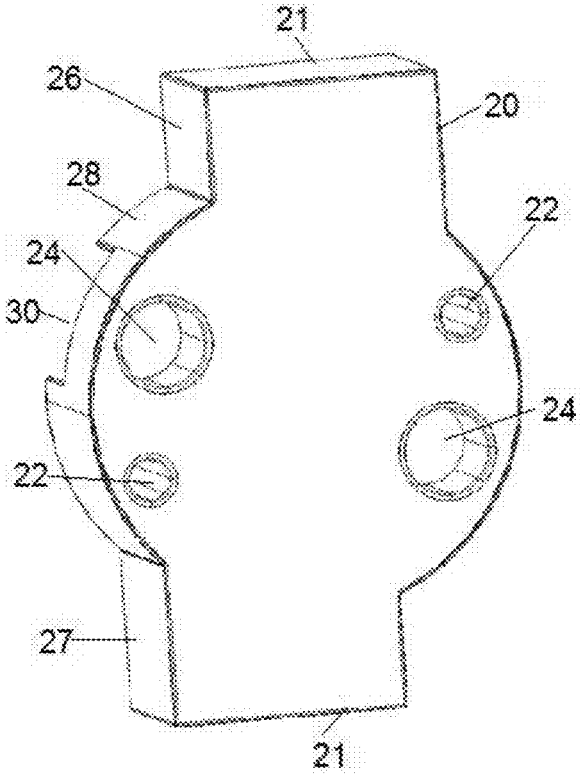
FIG. 8 is a top perspective view of the embodiment introduced in FIG. 2.
Figure 9:
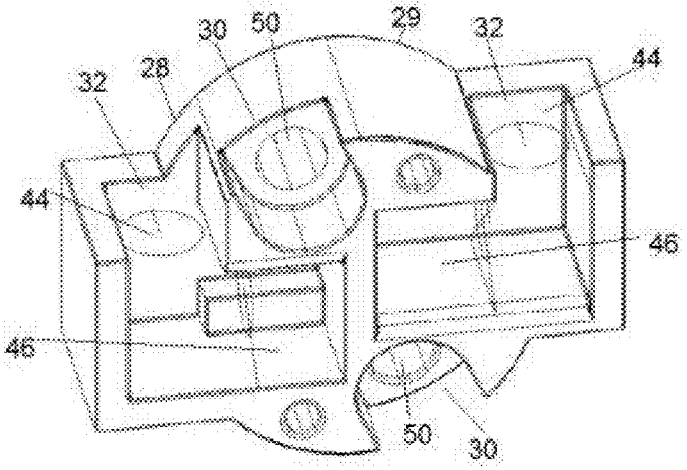
FIG. 9 is a side perspective view of the embodiment introduced in FIG. 2.

Referring now to the drawings in general and FIGS. 1-1*g* in particular, it will be understood that the illustrations are for the purpose of describing embodiments of the disclosure and are not intended to limit the disclosure or any inventions thereto. As seen in FIGS. 1-9, adjustable riser universal devices and assemblies are shown embodied according to the present disclosure to allow sensitive and secure adjustability of a light fixture in a coupled operating position. Those skilled in the art having the benefit of this disclosure will recognize additional riser support features, lighting features, the like in combination with the universal light fixture assemblies.

As shown in FIGS. 1-1*g*, adjustable riser 10 generally incudes lower plate 80, upper plate 90, and a fastener 16 adjustably securing upper plate 90 about lower plate 80 in any of the arrangements shown and described herein. As illustrated, lower plate 80 may provide an upper alignment surface 87 and an offset lip 82, extension, bracket, or the like. Fastener 16 may removably be aligned between the surface 87 and the offset lip 82. The adjustable upper plate 90 generally is secured about fastener 16 and adjustably positioned between the alignment surface 87 and the offset lip 82.

In particular examples, a lamp socket 200, including any of the lamp sockets, universal devices, and the like, shown and described herein, may be secured about the adjustable upper plate 90. The lower plate 80 may include a neck 81 spacing the alignment surface 87 and the offset lip 82. As illustrated, the alignment surface 87 may be separated substantially parallel about the offset lip 82, however those skilled in the art having the benefit of this disclosure will recognize additional orientations and arrangements. The assembly may include an elbow between the neck and the alignment surface. Similarly, the assembly may include an elbow between the neck and the offset lip, as well as additional support, elbow, neck, similar structural supports.

In certain examples, the lower plate 80 includes at least one distal fastener aperture 83. The at least one distal fastener aperture 83 may include internal threading to adjustably receive fastener 16, or the like. The offset lip 82 may include at least one proximate fastener aperture 84. The proximate fastener aperture 84 may include internal threading to adjustably receive fastener 16. Further, the lower plate 80 may include at least one distal fastener aperture 83 and the offset lip 82 includes at least one proximate fastener aperture 84, and wherein the distal fastener 83 aperture radially aligns about proximate fastener aperture 84 to provide any of the adjustability shown and described herein.

In particular examples, the lower plate 80 includes an alignment slot 85. The alignment slot 85 may include a central aperture 86. The lower plate 80 may include a mounting hole(s) 88 adapted to secure fastener 102 about a surface 300. The assembly may include a pair of mounting holes 88 offset about alignment slot 85.

In certain examples, the adjustable upper plate 90 includes a securement block 96. The securement block 96 may include a positioning aperture 98 adapted to adjustably receive fastener 16 to provide any of the sensitive and secure adjustability shown and described herein. The positioning aperture 98 may include internal female threads 99 adapted to receive opposing male threads of fastener 16. The upper plate 90 may include a mounting engagement surface 94 (and an opposing surface 95) adapted to secure any low voltage light socket 200 shown and described herein, for instance adjustably spaced about the lower plate 80.

In one embodiment, a universal lamp socket positionable about any of the riser embodiments and examples herein, includes an upper engagement surface, however those skilled in the art having the benefit of this disclosure will recognize additional engagement positions and surfaces; a pair of opposing terminal block inlet cavities 32 having a distal block 46 in communication with a connection port 22 aligned about the engagement surface; and a pair of offset connect mount chambers 30 having a connection aperture 50 aligned about the engagement surface.

In particular examples, the universal body comprises at least one mounting rail, support, bracket, and the like. The universal body may include a substantially hollow body, including covers, shields, assembled portions, and the like. The terminal block inlet cavities may receive a power input 104, including any of the power supplies shown and described herein. A fastening member 74, or the like, may protrude from the connection port, for instance fixedly securing a power input about the terminal block. The terminal block inlet cavities may include a proximate block 44. The distal block 46 may be substantially offset about the proximate block 46.

In certain examples, a fastening member 74 protrudes from the connection port in the adjustable shape of a protruding fastener. The protruding fastener may include a screw type connection. The connection port may include internal receiving threads. However, those skilled in the art having the benefit of this disclosure will recognize additional fasteners and fastening supporting elements.

In particular examples, the power input 104 may include a low voltage landscaping lighting cable. The landscape cable may directly deliver power about the terminal block inlet cavities. Applicant has unexpectedly discovered the landscape cable may directly deliver power about the socket free of a connector, heat shrink, or similar element required by traditional systems.

In certain examples, the device may include a partially exposed bottom. The pair of opposing terminal block inlet cavities 32, 32 and the pair of offset connect mount chambers 30, 30 may be aligned about the partially exposed bottom. The device may include a convex support 29 aligned between a first terminal block inlet and a first connect mount chamber.

In particular examples, the first connect mount chamber 30 separates the pair of opposing terminal block inlet cavities 32,32. The second connect mount chamber may be aligned on a reverse face of the pair of opposing terminal block inlet cavities. The connect mount chambers may have a connection aperture adapted to receive a lamp 100. The device may removably position any light fixture shown and described in any arrangement, including removable arrangements. The light fixture may include a bi-pin light fixture. The connection aperture may include secure a quick connect member. The connection aperture may secure a push-to-connect member. The connection aperture may be aligned radially about the mount chamber. The connection aperture may include socket springs 72, for instance mini socket springs.

In certain examples, the connection aperture comprises support plates 70. The connection aperture may include fasteners, for instance adjustable fasteners. The device may include a light fixture. The device a light fixture a support system.

In one embodiment, a lamp socket includes a universal body having an upper engagement surface; a pair of opposing terminal block inlet cavities 32 that generally receive a power input 104, and having a distal block 46 in communication with a connection port aligned about the engagement surface; and a pair of offset quick-connect mount chambers 30 having a connection aperture 24 aligned about the engagement surface and adapted to receive any of the light fixtures shown and described herein.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. An adjustable riser assembly comprising:

a. a lower plate having an alignment surface and an offset lip being offset about said alignment surface;

b. a fastener removably secured between said alignment surface and said offset lip;

c. an adjustable upper plate secured about said fastener and adjustably positioned between said alignment surface and said offset lip; and d. a lamp socket comprising a universal body with an upper engagement surface, a pair of opposing terminal block inlet cavities and a distal block in communication with a connection port aligned about said engagement surface, and a pair of offset quick-connect mount chambers having a connection aperture aligned about said engagement surface.

2. The assembly of claim 1, wherein said lower plate includes a neck spacing said alignment surface and said offset lip.

3. The assembly of claim 2, wherein said alignment surface being separated and substantially parallel to said offset lip.

4. The assembly of claim 1, wherein said lower plate includes an alignment slot.

5. The assembly of claim 1, wherein said upper plate includes a mounting engagement surface adapted to secure a low voltage light socket adjustably spaced about said lower plate.

6. An adjustable riser assembly comprising:

a. a lower plate having a proximate surface engagement portion and a spaced apart distal lip, and an alignment surface;

b. an upper plate adapted to support a lamp socket and adjustably secured between said proximate surface engagement portion and said spaced apart distal lip, and wherein said lamp socket includes a universal body having a pair of opposing terminal block inlet cavities adapted to receive a power input, and having a distal block in communication with a connection port aligned about said surface engagement portion; and a pair of offset quick-connect mount chambers having a connection aperture aligned about said surface engagement portion; and c. a neck spacing said proximate surface engagement portion and said spaced apart distal lip.

7. The assembly of claim 6, wherein said adjustable upper plate includes a securement block.

8. A light fixture system comprising:

a. a lower plate having an alignment surface and an offset lip being offset about said alignment surface;

b. a fastener removably secured between said alignment surface and said offset lip;

c. an adjustable upper plate secured about said fastener and adjustably vertically positioned between said alignment surface and said offset lip; and d. a lamp socket secured about said adjustable upper plate, and wherein said lamp socket includes a universal body having an upper engagement surface; a pair of opposing terminal block inlet cavities adapted to receive a power input, and having a distal block in communication with a connection port aligned about said engagement surface; and a pair of offset quick-connect mount chambers having a connection aperture aligned about said engagement surface and adapted to receive a bi-pin light fixture.

9. The system of claim 8, wherein a landscape cable directly delivers power about terminal block inlet cavities.

10. The system of claim 8, wherein a landscape cable directly delivers power about said socket free of a connector.

11. The system of claim 8, wherein a landscape cable directly delivers power about said socket.

12. The system of claim 8, wherein a pair of opposing terminal block inlet cavities and a pair of offset quick-connect mount chambers aligned about said partially exposed bottom.

13. The system of claim 8, wherein an universal body comprises at least one mounting ground connection.

14. The system of claim 8, wherein an upper engagement surface adapted to removably engage a light fixture.

15. The system of claim 8, wherein a first quick-connect mount chamber separates a pair of opposing terminal block inlet cavities, and a second quick-connect mount chamber aligned on a reverse face of said pair of opposing terminal block inlet cavities.

16. The system of claim 8, wherein opposing terminal block inlet cavities comprise said distal block in communication with a proximate block.

17. The system of claim 8, wherein a landscape cable directly delivers power about terminal block inlet cavities.

* * * * *